United States Patent [19]

Murakami et al.

[11] 4,050,927

[45] Sept. 27, 1977

[54] ALLOYED STEEL

[75] Inventors: Shinichi Murakami, Osaka; Katsutaro Akamatsu, Hirakata; Hisashi Hiraishi, Kyoto, all of Japan

[73] Assignee: Kubota, Ltd., Japan

[21] Appl. No.: 636,643

[22] Filed: Dec. 1, 1975

[51] Int. Cl.[2] ..... C22C 30/00

[52] U.S. Cl. ..... 75/122; 75/134 F

[58] Field of Search ..... 75/171, 122, 134 F

[56] References Cited

U.S. PATENT DOCUMENTS

| | | | |
|---|---|---|---|
| 3,723,108 | 3/1973 | Twigg et al. | 75/171 |

FOREIGN PATENT DOCUMENTS

| | | | |
|---|---|---|---|
| 45-28106 | 8/1968 | Japan | 75/134 F |
| 47-22317 | 2/1971 | Japan | 75/122 |
| 47-18332 | 5/1972 | Japan | 75/122 |
| 669,579 | 4/1952 | United Kingdom | 75/134 F |
| 674,023 | 6/1952 | United Kingdom | 75/171 |
| 710,413 | 6/1954 | United Kingdom | 75/171 |

OTHER PUBLICATIONS

"A Dictionary of Metallurgy, " Merriman, 1959, p. 56.

*Primary Examiner*—Arthur J. Steiner
*Attorney, Agent, or Firm*—Wenderoth, Lind & Ponack

[57] ABSTRACT

An alloyed steel having high heat and wear resistance is disclosed. This alloyed steel contain carbon, silicon, manganese, phosphorus, sulfur, chromium, nickel, cobalt, tungsten, niobium and iron and other impurities as the remainder. A deoxidizing agent may be added.

13 Claims, 3 Drawing Figures

ALLOYED STEEL

BACKGROUND OF THE INVENTION

The present invention relates to an alloyed steel and, more particularly, to an alloyed steel having high resistance to heat and wear and high strength at high temperature.

The present invention pertains to the alloyed steel which is suited as a material for rails or like guides of a type installed on the hearth within a heating furnace.

An alloyed steel, identified by UM Co-50 alloy, which contains 0.12% carbon, 1.10% silicon, 1.05% manganese, 0.013% phosphorus, 0.08% sulfur, 31.0% chromium, 50.8% cobalt and iron as the remainder, is known to have high resistances to heat, wear and sulfuration. Because of these properties, the UM Co-50 alloy has heretofore been largely employed as a material for rails or as guides of a type installed on the hearth within a heating furnace for heat-treatment of slabs of metal. However, it has recently been found that the UM Co-50 alloy involves some disadvantages which will now be described.

One disadvantage is that, although the UM Co-50 alloy which has been used in the furnace for reheating the slab of metal wherein the temperature is within the range of 1,100° to 1,250° C. exhibits a satisfactory performance, it is susceptible to cracking when exposed at the temperature of not more than 1,100° C. during preheating, because of change in structure such as formation of the $\sigma$-phase.

Another disadvantage is that the UM Co-50 alloy exhibits poor welding properties. One reason for this thought to be the presence of an eutectic within the grain boundary and the dendrite tends to invite cracking in a heat affected zone formed during welding. Another reason for this is thought to be that the deformability and form of the $\epsilon$-phase band cause cracking in the crystalline structure.

SUMMARY OF THE INVENTION

Accordingly, an essential object of the present invention is to provide an alloyed steel having improved resistances to heat and wear and high strength at high temperature, with substantial elimination of the possibility of crack formation and difficulty in welding, which will otherwise result from change in structure occurring when exposed at the temperature not more than 1,100° C. such as inherent in the UM Co-50 alloy.

Another important object of the present invention is to provide an alloyed steel of the type referred to above, which exhibits a sufficiently high physical strength at elevated temperature.

A further object of the present invention is to provide an alloyed steel of the type referred to above, which can satisfactorily and effectively used as a material for rails or like guides to be installed on the hearth within a heating furnace.

BRIEF DESCRIPTION OF THE DRAWING

The present invention will readily be understood from the following description taken in conjunction with a preferred embodiment thereof with reference to the accompanying drawings, in which.

DETAILED DESCRIPTION OF THE INVENTION

Figure 1:
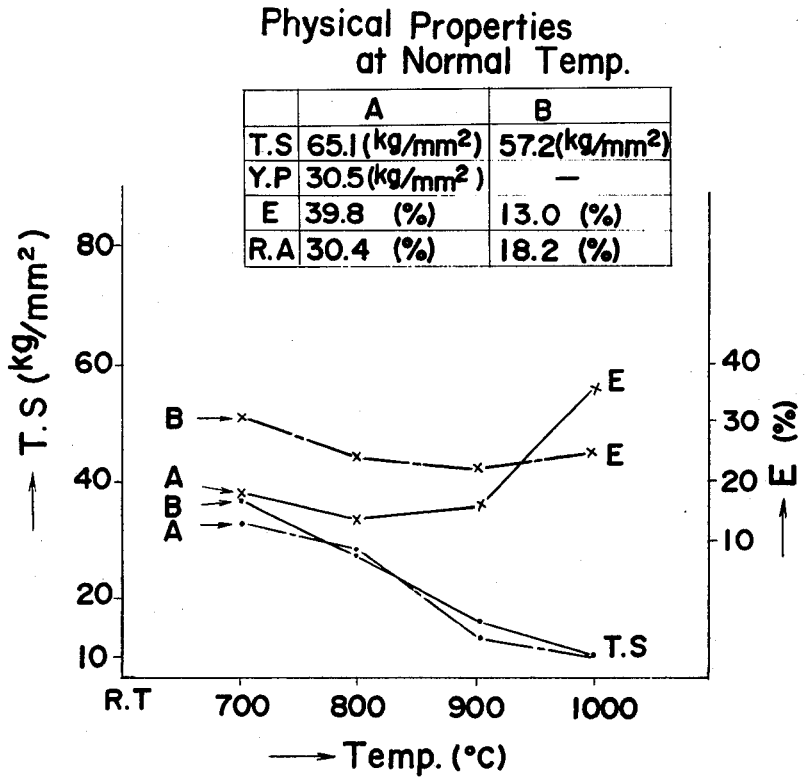
FIG. 1 is a graph illustrating the physical strength of an alloyed steel according to the present invention in comparison to the known UM Co-50 alloy.

According to the present invention, an alloyed steel having improved resistance to heat and wear contains carbon in an amount within the range of 0.3 to 0.5%; silicon in an amount within the range of 1.0 to 1.8%; manganese in an amount within the range of 1.0 to 1.8%; chromium in an amount within the range of 26 to 30%; nickel in an amount within the range of 18 to 22%; cobalt in an amount within the range of 18 to 22%; tungsten in an amount within the range of 0.5 to 6%; niobium in an amount within the range of 0.5 to 4%; and, as a remainder, iron and other industrially inevitable impurities, said percentage being based on the total weight of the composition.

Hereinafter, the reason for the uppermost and lowermost limits of the amount of each of the elements constituting the composition of the alloyed steel according to the present invention will now be described.

As regards carbon, it acts to improve the wear resistance at ambient temperature, and the wear and heat resistances at elevated temperature, of the resultant alloyed steel due to the fact that carbon remains in the austenite structure in solid-solved state to improve the hardness of the matrix and that carbon cooperates chromium, molybdenum and tungsten to form a carbide. If carbon is employed in an amount in excess of 0.5 wt%, the hardness of the resultant alloyed steel will excessively increase with reduction in toughness thereof and, therefore, difficulty of welding remains. On the other hand, if it is employed in an amount not more than 0.3 wt%, improvement in wear resistance will not be expected.

As regards silicon, although it is useful as a deoxidizing agent and is effective to impove the weldability and heat resistance of the resultant alloyed steel, the weldability and heat resistance will be reduced if it is employed in an amount not more than 1.0 wt%. On the other hand, if the silicon is employed in an amount in excess of 1.8 wt%, the toughness of the resultant alloyed steel will adversely be affected with substantial reduction in castability.

As regards manganese, the uppermost and lowermost limits of the amount to be employed are respectively limited to 1.8 wt% and 1.0 wt% from the viewpoint of a deoxidizing agent and improvement in weldability. It is to be noted that, if manganese is employed together with Co-Si and Al, it acts as an effective deoxidizing agent.

As regards chromium, it acts to improve the resistance to oxidation at elevated temperature and also the wear resistance. However, if the chromium is employed in an amount in excess of 30 wt%, the toughness and castability of the resultant alloyed steel will adversely be affected. On the other hand, if it is employed in an amount not more than 26 wt%, improvement in wear resistance can not substantially be expected.

As regards nickel and cobalt, each of these elements is necessary in order that the matrix be transformed into an austenite structure thereby improving the toughness and consequent improvement of the physical strength at elevated temperature. Of these elements, cobalt is known as an expensive element. Though the employment of cobalt in an amount as small as possible is preferred in view of the brittle fracture, this element is necessary to improve the solid-solubility of tungsten and also to improve the hardness of the austenite structure and, therefore, the uppermost and lowermost limits of the amount to be employed are determined to be 22 wt% and 18 wt%, respectively. The other element, that is, nickel is effective to stabilize the austenite structure if employed in an amount not less than 18 wt%. However, if nickel is employed in an amount in excess of 22 wt%, no further improvement can be expected.

As regards tungsten, it is necessary to improve the wear resistance at elevated temperature. It has been found that, in order to improve the wear resistance at 1,100° C., the amount of tungsten to be employed is recommended within the range of 0.5 to 3 wt%. However, in order to improve the wear resistance at the temperature of 1,100° to 1,200° C., 0.5 to 6 wt% is recommended.

As regards niobium, this element is necessary to improve the physical strength at elevated temperature. However, with the resistance to oxidation being taken into consideration, 2 to 4 wt% is necessary in order to improve the physical strength at 1,100° C. and 0.5 to 2 wt% is necessary in order to improve the physical strength at 1,100° to 1,200° C. Therefore, the uppermost and lowermost limits of the amount of niobium to be employed are respectively fixed at 0.5 to 4 wt%.

The remainder employed is iron and other industrially inevitable impurities.

The present invention will now be described by way of example which is not intended to limit the scope of the present invention.

A sample of alloyed steel according to the present invention which contains carbon in an amount of 0.32 wt%, silicon in an amount of 1.88 wt%, manganese in an amount of 1.24 wt%, phosphorus in an amount of 0.007 wt%, sulfur in an amount of 0.006 wt%, chromium in an amount of 27.17 wt%, nickel in an amount of 20.17 wt%, cobalt in an amount of 20 wt%, tungsten in an amount of 1.5 wt%, niobium in an amount of 1.5 wt% and an aluminum deoxidizing agent in an amount of 12.01 wt%, was cast.

Figure 3:
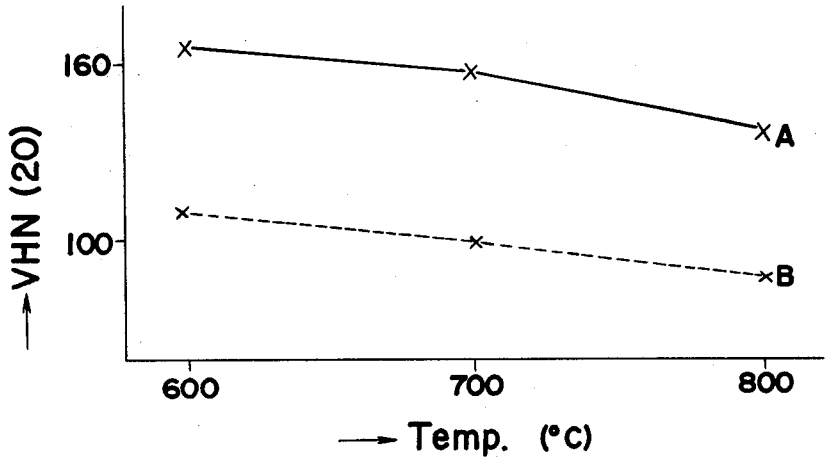
FIG. 3 is a graph illustrating the hardness of the alloyed steel according to the present invention and that of the known UM Co-50 alloy in relation to the temperature.
Figure 2:
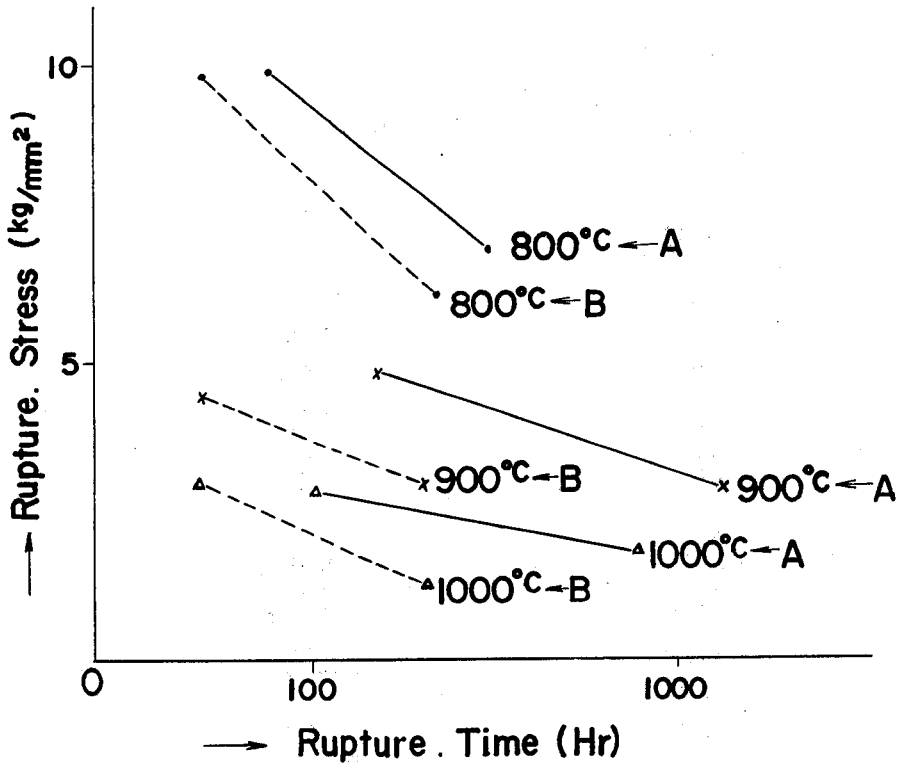
FIG. 2 is a graph illustrating the result of a rupture test subjected to the alloyed steel according to the present invention and to the known UM Co-50 alloy.

The sample of alloyed steel in the above composition, was tested to determine the physical strength, the creep strength at rupture and the hardness at elevated temperature, the results of these tests being shown in the respective graphs of FIGS. 1 to 3.

For the purpose of comparison, the UM Co-50 alloy was also tested and the results of the tests are shown in the graphs of FIGS. 1 to 3.

In the graphs of FIGS. 1 to 3, the sample of alloyed steel according to the present invention and that of the UM Co-50 alloy are respectively identified by A and B.

From the graphs of FIGS. 1 to 3, it is clear that the alloyed steel according to the present invention substantially eliminates the disadvantages inherent in the UM Co-50 alloy and which have hereinbefore been described.

Although the present invention has been fully described by way of example, it should be noted that various changes and modifications are apparent to those skilled in the art, such changes and modifications being to be understood as included within the true scope of the present invention unless they depart therefrom.

What is claimed is:

1. An alloy having high heat and wear resistance, which consists essentially of carbon in an amount of 0.30 to 0.50%, silicon in an amount of 1.0 to 1.8%, manganese in an amount of 1.0 to 1.8%, chromium in an amount of 26 to 30%, nickel in an amount of 18 to 22%, tungsten in an amount of 0.5 to 6%, nobium in an amount of 0.5 to 4%, cobalt in an amount of 18 to 22%, and iron and other impurities as a remainder, said percentage being based on the total weight of the composition.

2. An alloy as claimed in claim 1, wherein the amount of said tungsten is 0.5 to 3%.

3. An alloy as claimed in claim 1, wherein the amount of said niobium is 0.5 to 2%.

4. An alloy as claimed in claim 1, wherein the amount of said tungsten is 0.5 to 3% and the amount of said niobium is 0.5 to 2%.

5. An alloy as claimed in claim 1, wherein an effective amount of deoxidizing agent is added to said alloy.

6. An alloy as claimed in claim 5, wherein said deoxidizing agent is aluminum.

7. An alloy as claimed in claim 2, wherein an effective amount of deoxidizing agent is added to said alloy.

8. An alloy as claimed in claim 7, wherein said deoxidizing agent is aluminum.

9. An alloy as claimed in claim 3, wherein an effective amount of deoxidizing agent is added to said alloy.

10. An alloy as claimed in claim 9, wherein said deoxidizing agent is aluminum.

11. An alloy as claimed in claim 4, wherein an effective amount of deoxidizing agent is added to said alloy.

12. An alloy as claimed in claim 11, wherein said deoxidizing agent is aluminum.

13. An alloy as claimed in claim 1 which consists of carbon in an amount of 0.30 to 0.50%, silicon in an amount of 1.0 to 1.8%, manganese in an amount of 1.0 to 1.8%, chromium in an amount of 26 to 30%, nickel in an amount of 18 to 22%, tungsten in an amount of 0.5 to 6%, niobium in an amount of 0.5 to 4%, cobalt in an amount of 18 to 22%, the balance being iron and other unavoidable impurities.

* * * * *